United States Patent [19]

Henle

[11] 4,325,418

[45] Apr. 20, 1982

[54] APPARATUS FOR FILLING CONTAINERS

[75] Inventor: Karl Henle, Reinbek, Fed. Rep. of Germany

[73] Assignee: Hauni-Werke Korber & Co. KG., Hamburg, Fed. Rep. of Germany

[21] Appl. No.: 119,543

[22] Filed: Feb. 7, 1980

[30] Foreign Application Priority Data

Feb. 23, 1979 [DE] Fed. Rep. of Germany ..... 2907015

[51] Int. Cl.[3] ..... B65B 43/42

[52] U.S. Cl. ..... 141/182; 141/103; 141/172; 141/183; 141/191

[58] Field of Search ..... 141/103, 114, 167, 168, 141/172, 173, 181, 182, 183, 191, 270, 283, 284

[56] References Cited

U.S. PATENT DOCUMENTS 3,941,170 3/1976 Maulini ..... 141/183

*Primary Examiner*—Frederick R. Schmidt

*Attorney, Agent, or Firm*—Kontler & Grimes

[57] ABSTRACT

Apparatus for filling containers whose upper ends are open and which are moved seriatim and stepwise to a filling station has a receptacle which is disposed at a level above a container at the filling station and below a metering device whose lower end can be opened to discharge a metered quantity of flowable material onto a normally horizontal bottom wall of the receptacle. The receptacle is thereupon pivoted to move a discharge opening thereof into the open end of the container at the filling station and to incline the bottom wall to such an extent that the metered quantity of flowable material slides off the bottom wall and enters the container by way of the opening. The opening is normally sealed by a flap which is opened when the opening extends into the open end of a container at the filling station.

13 Claims, 11 Drawing Figures

Fig. 4
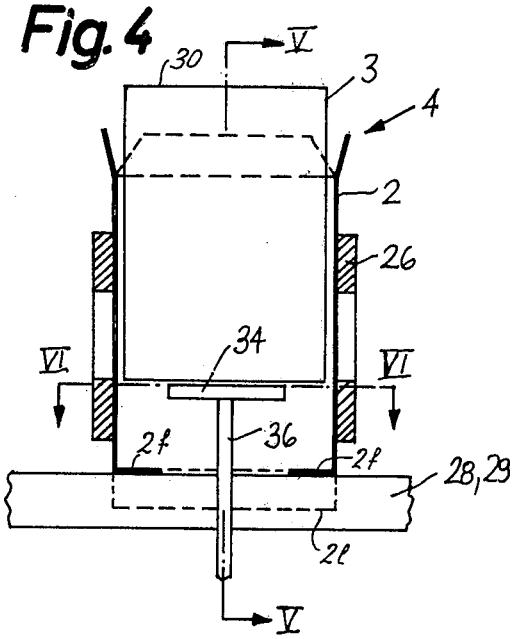
Fig. 5
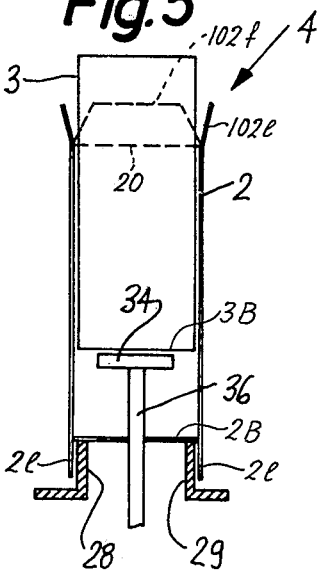
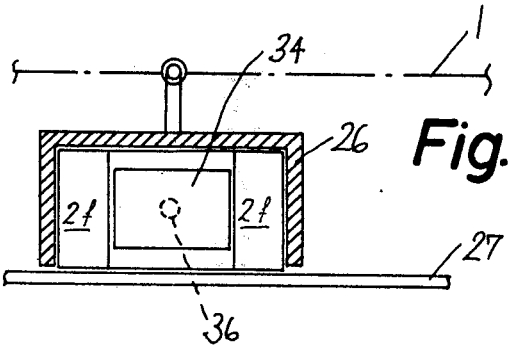
Fig. 6

Fig.7
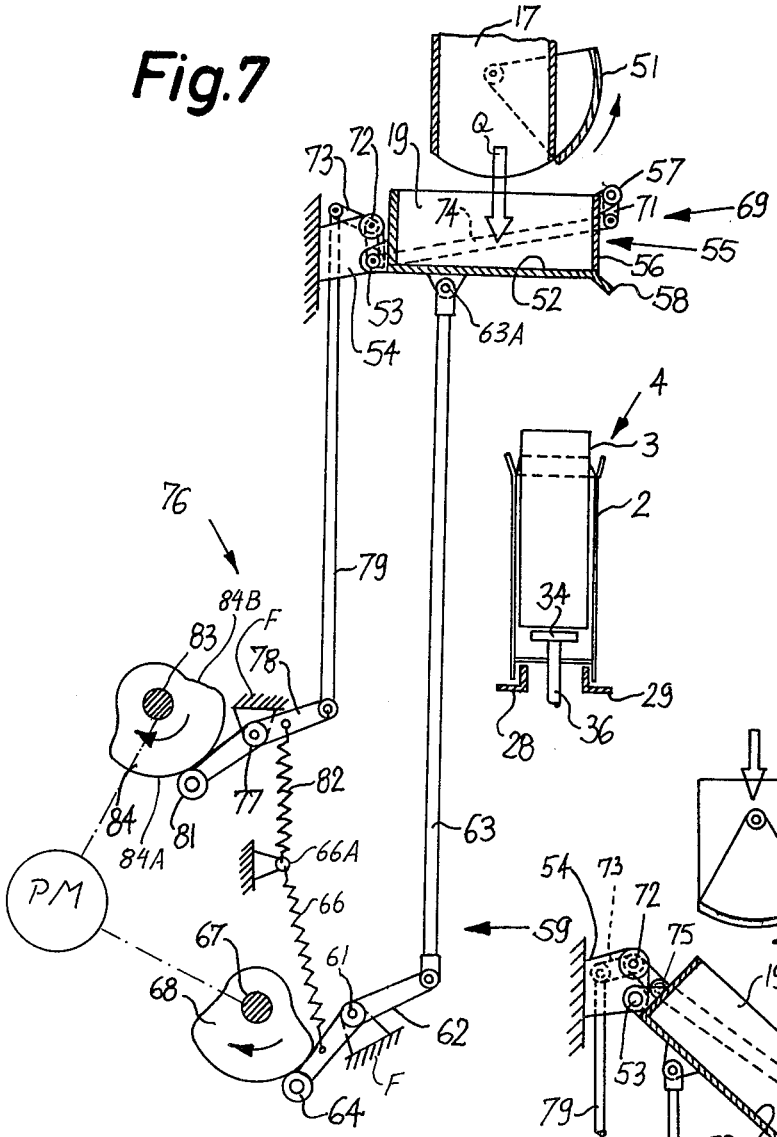
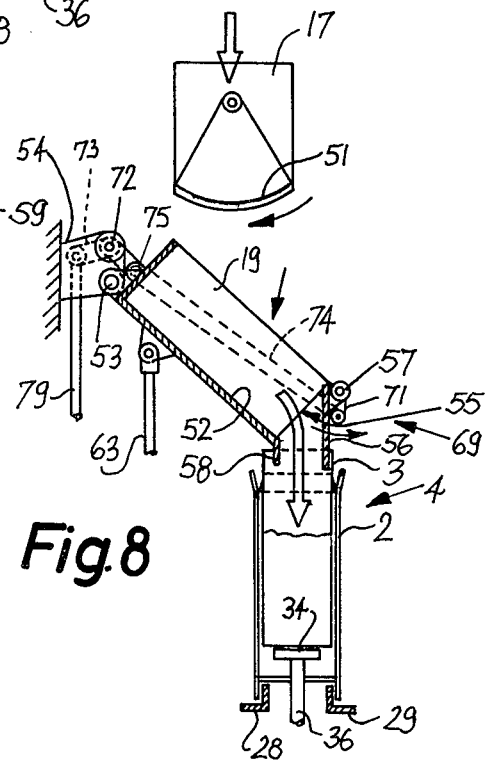
Fig.8

APPARATUS FOR FILLING CONTAINERS

CROSS-REFERENCE TO RELATED APPLICATION

The apparatus of the present invention includes certain components which are similar to those described and shown in commonly owned copending application Ser. No. 096,422 filed Nov. 21, 1979 by Karl Henle and Nils von Wichert for "Method and apparatus for filling and sealing containers".

BACKGROUND OF THE INVENTION

The present invention relates to apparatus for filling containers with flowable materials, and more particularly to improvements in apparatus for introducing metered quantities of flowable materials into successive containers. Still more particularly, the invention relates to improvements in apparatus for introducing metered quantities of flowable materials (e.g., foodstuffs) into containers which are formed immediately ahead of the filling station and are sealed immediately downstream of such station.

It is already known to install one or more metering devices at a level above the path of movement of successive empty containers which are to receive metered quantities of flowable material during a period of dwell at the filling station below the metering device or devices. It is also known to use in such apparatus one or more receptacles which are installed between the metering device or devices and the container or containers therebelow and serve as a means for guiding the material into empty containers. Reference may be had to German Auslegeschrift No. 1,137,670 which discloses an apparatus for filling containers with a pulverulent granular material. The receptacles which are disclosed in this publication receive flowable material from several weighing devices by way of funnels and direct the material into containers which are in constant motion. Therefore, the receptacles must share the movements of containers which advance past the filling station and must perform return strokes in order to move into positions of register with the next-following containers.

A drawback of the just described conventional filling apparatus is that the distance along which the flowable material descends by gravity is considerable so that such apparatus cannot properly fill containers with brittle or other readily breakable or deformable materials, such as bakery products. Another drawback of the just described conventional apparatus is that the receptacle or receptacles must be moved by complex mechanisms which cause the receptacle to perform forward strokes during admission of flowable materials into moving containers and rapid return strokes during the intervals following admission of flowable materials into containers.

OBJECTS AND SUMMARY OF THE INVENTION

An object of the invention is to provide a novel and improved filling apparatus which can admit brittle, deformable or other sensitive materials into containers without damaging or deforming such materials.

Another object of the invention is to provide a filling apparatus which insures that each and every container of a long series of successive containers receives the same quantity of flowable material and that the condition or aggregate state of such material does not change during transfer from the metering device or devices into the respective containers.

A further object of the invention is to provide a novel and improved mobile receptacle for transfer of flowable materials from one or more metering devices into containers in a filling apparatus of the above outlined character.

Another object of the invention is to provide the apparatus with novel and improved means for moving the receptacle or receptacles between several positions in which the receptacle or receptacles are ready to receive metered quantities of flowable materials or to discharge such metered quantities into containers.

A further object of the invention is to provide a filling apparatus whose operation can be automated so as to eliminate the need for continuous or even intermittent inspection, which can process large quantities of flowable materials per unit of time, and which can be used for filling containers with a wide variety of pulverulent, granular or otherwise configurated materials.

One feature of the invention resides in the provision of an apparatus for transferring a flowable (granular, pulverulent or particulate) material into successive containers having open ends, preferably open upper ends of bags which constitute inner envelopes and are inserted into box-shaped outer envelopes of such containers. The apparatus comprises a chain conveyor or other suitable means for transporting containers along a predetermined path (preferably in stepwise fashion along a substantially horizontal path), a metering device which may constitute a conveyor or a scale located at a level above a portion of the path for containers and constructed and assembled to accumulate and discharge metered quantities of a flowable material (e.g., biscuits or other edible commodities), and a receptacle which is disposed intermediate the metering device and a container in the aforementioned portion of the path and has a bottom wall as well as a material evacuating opening. The receptacle is movable between a first position in which the bottom wall is closely (preferably immediately) adjacent to the metering device to receive a metered quantity of flowable material therefrom and a second position in which the opening is at least closely adjacent to (and preferably extends into) the open end of the container in the aforementioned portion of the path at a level below the bottom wall and the bottom wall slopes downwardly to such an extent that a metered quantity of flowable material enters the container in the aforementioned portion of the path by sliding off the bottom wall and by passing through the opening of the receptacle. The apparatus further comprises means for moving the receptacle between the first and second positions. Still further, the apparatus preferably comprises a flap, a gate or an analogous closure movable between first and second positions in which the closure respectively exposes and seals the opening of the receptacle and means for pivoting, reciprocating and/or otherwise moving the closure between the just mentioned positions.

The receptacle may constitute a one-piece bowl or a composite (e.g., two-piece) body, one part of which includes the bottom wall and another part of which is formed with the material evacuating opening. The parts of the receptacle can be moved as a unit, or they can be constructed and assembled for movement relative to each other.

The novel features which are considered as characteristic of the invention are set forth in particular in the appended claims. The improved filling apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 4 is an enlarged vertical sectional view as seen in the direction of arrows from the line IV—IV of FIG. 2;

FIG. 5 is a vertical sectional view as seen in the direction of arrows from the line V—V of FIG. 4;

FIG. 6 is a horizontal sectional view as seen in the direction of arrows from the line VI—VI of FIG. 4;

FIG. 7 is an enlarged partly elevational (see the arrow VII in FIG. 1) and partly vertical sectional view of the filling apparatus in the machine of FIG. 1, the receptacle of the filling apparatus being shown in that position in which its bottom wall is ready to receive a batch of flowable material from the metering device;

FIG. 8 illustrates the structure of FIG. 7, with the receptacle in a position which it assumes during transfer of a batch of flowable material into the bag of a container at the filling station;

DESCRIPTION OF THE PREFERRED EMBODIMENTS

Figure 1:
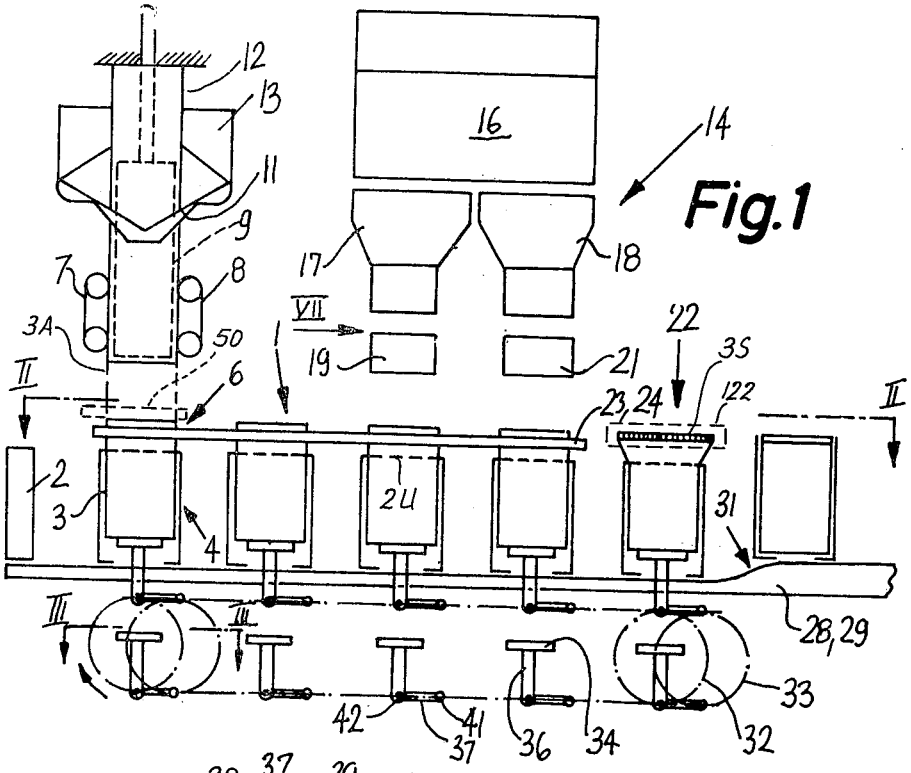
FIG. 1 is a schematic elevational view of a machine including a filling apparatus which embodies the invention.
Figure 3:
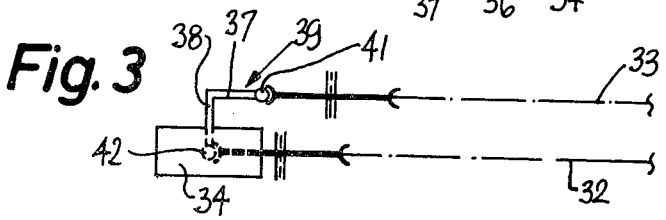
FIG. 3 is a schematic horizontal sectional view as seen in the direction of arrows from the line III—III of FIG. 1.

The machine of FIG. 1 comprises a transporting unit which includes an endless chain conveyor 1 serving to transport the components of containers 4. Such components include foldable or collapsible cardboard boxes 2 and bags 3 which are inserted into the boxes prior to filling with a flowable material.

The bags 3 are formed at a level above an assembling or inserting station 6 adjacent to a first portion of an endless path which is defined by the chain conveyor 1. As shown in the upper left-hand portion of FIG. 1, the means for forming successive bags 3 comprises a hollow mandrel 12 and a shaping member 11. A sheet 13 of metallic or plastic foil is fed by suitable conveyor means, not shown, into the range of the shaping member 11. Such sheet is draped around the hollow mandrel 12 to be converted into a tube 3A which is advanced downwardly, as viewed in FIG. 1, by a plunger 9 which is reciprocable in and downwardly beyond the mandrel 12. Conveyors 7 and 8 (preferably endless belt conveyors) cooperate with the plunger 9 to transport successive lengths of the tube 3A downwardly toward the assembling station 6. A suitable sealing device, not shown, seals the lower end of the tube 3A prior to introduction into a box 2 therebelow. In the illustrated embodiment, the mandrel 12 has a rectangular cross-sectional outline because the machine is intended to form, fill and seal containers 4 of similar cross-sectional configuration.

The assembling station 6 is followed by a filling station 14 adjacent to a further portion of the endless path which is defined by the chain conveyor 1. The components of the apparatus at the filling station 14 comprises a weighing device 16 with two metering conveyors 17, 18 which respectively deliver metered quantities of flowable material into two intercepting receptacles 19 and 21. The filling station 14 is followed by a sealing station 22 at which the readily accessible open ends of successive bags 3 are sealed, as at 3S, while such open ends extend upwardly and beyond the open upper ends 2U of the respective boxes 2. The exact details of the sealing device or devices at the station 22 form no part of the present invention. Such devices are well known in the art of making plastic or other bags.

The apparatus of FIG. 1 further comprises two elongated suction applying devices 23, 24 which flank the path of forward movement of upper ends 3U successive bags 3. The devices 23, 24 have suction ports which face the adjacent sides of the open upper ends 3U of the bags 3 so as to maintain such upper ends in open positions during transport past the receptacles 19 and 21 at which the bags are filled with a flowable pulverulent, granular or larger particulate material. For example, the bags 3 can receive comminuted foodstuffs or similar commodities. Each of the suction applying devices 23, 24 may constitute an elongated hose with a plurality of orifices facing the adjacent sides of successive bags 3.

As shown in FIGS. 1, 2 and 4 to 6, the chain conveyor 1 carries a plurality of discrete holders 26 for boxes 2. Each holder 26 has a substantially U-shaped configuration so that it can engage three different sides of a box 2. In order to prevent escape of boxes 2 from the respective holders 26, the apparatus further comprises a barrier 27 (see FIG. 6) which is an elongated strip or bar extending along the open sides of successive holders 26. Each box 2 which is inserted into a holder 26 in the region of the left-hand sprocket wheel 43 for the chain conveyor 1 (as viewed in FIG. 2) is open at the top (2U) and is at least partially open at the bottom (2B), i.e., both ends of the box are open so that a bag 3 (whose lower end 3B is closed) can be inserted from above and that a supporting device in the form of a horizontal platform 34 can be introduced into each box 2 from below while such box advances toward the filling station 14 and thereupon toward and beyond the sealing station 22. In fact, a platform 34 can be introduced into a box 2 from below at a time when such box reaches the assembling station 6. The holders 26 on the chain conveyor 1 are equally spaced from each other and are advanced stepwise in a counterclockwise direction, as viewed in FIG. 2.

Figure 2:
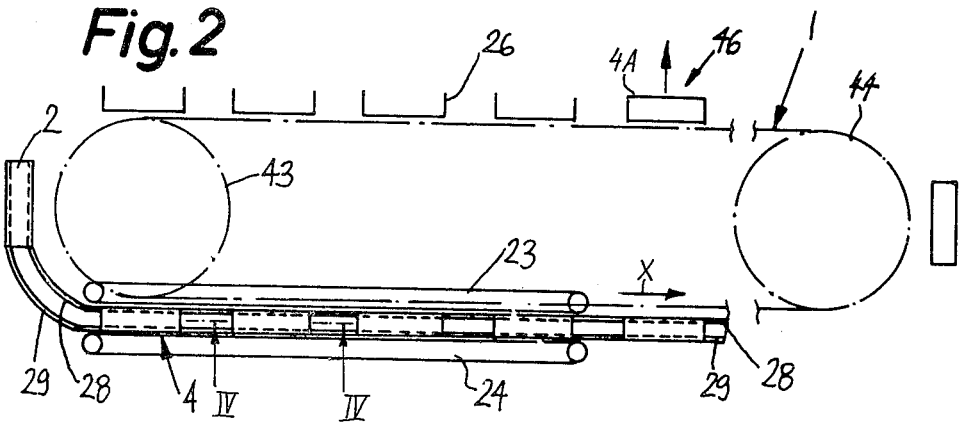
FIG. 2 is a schematic horizontal sectional view as seen in the direction of arrows from the line II—II of FIG. 1.

In order to prevent the boxes 2 from slipping downwardly and out of the respective holders 26, the transporting unit including the chain conveyor 1 further comprises two elongated guide rails 28 and 29, which are best shown in FIGS. 2, 4 and 5. These guide rails extend from below into the path of movement of boxes 2 from the station 6 to the station 14 and thereupon to the station 22. As shown in FIG. 5, the guide rails 28, 29 have a substantially L-shaped cross-sectional outline and their upwardly extending legs engage the inwardly bent smaller flaps 2*f* at the lower ends 2B of successive boxes 2. The larger or longer flaps 2*l* are outwardly adjacent to the upwardly extending legs of the respective guide rails 28, 29. The boxes 2 which are inserted into successive holders 26 and the station which is located to the left of the sprocket wheel 43 of FIG. 2 descend onto the guide rails 28, 29 and slide therealong in stepwise fashion toward and beyond the sealing station 22.

FIG. 1 shows that the right-hand portions of the rails 28, 29 slope upwardly, as at 31, to define two cam tracks or ramps (only one shown) constituting lifting means along which successive boxes 2 slide to move to a higher level whereby the sealed and filled bags 3 penetrate deeper into the respective boxes prior to folding of the flaps 102*f*, 102*l* at the upper ends 2U of such boxes in order to complete the conversion of boxes and filled and sealed bags into filled and closed containers 4A. The closing of the lower and upper ends of successive boxes 2 is completed not later than when such boxes reach a removing station 46 which is shown in FIG. 2 and at which the containers 4A are removed from the respective holders 26. The empty holders 26 thereupon advance along the upper reach of the chain conveyor 1, as viewed in FIG. 2, toward the station where they receive fresh empty boxes 2.

A further transporting unit including two endless chain conveyors 32 and 33 is disposed at a level below the chain conveyor 1. The conveyors 32 and 33 are slightly offset with respect to each other, as considered in the longitudinal direction of the guide rails 28, 29. These conveyors support a set of equally spaced platforms 34 in such positions that the top surfaces of the platforms remain horizontal, regardless of whether the platforms move upwardly in the region of the station 6, along the horizontal stretches of the conveyors 32, 33, or downwardly in the region which is located downstream of the sealing station 22. The carrier means for each support or platform 34 comprises an upright rod 36 the upper end of which is rigid with the respective platform 34, and an L-shaped lever 39 with legs 37, 38 which are rigidly connected to each other. The leg 38 carries the rod 36. The free ends of the legs 37, 38 are respectively connected to the chain conveyors 33, 32 by universal joints 41, 42. The just described mounting for the platforms 34 insures that their top surfaces remain horizontal and that each of these platforms has a vertical component of movement at each end of the path which is defined by the chain conveyors 32, 33, i.e., that successive platforms 34 can penetrate from below through the partially open lower ends 2B of successive boxes 2 at the station 6 and that successive platforms 34 can be withdrawn downwardly through and below the partially open ends 2B of the respective boxes 2 at a location downstream of the station 22. This enables the boxes 2 to rise relative to the corresponding bags 3 (which are already filled and sealed) during travel of the boxes along the lifting means including the cam tracks 31 of the guide rails 28 and 29.

FIG. 7 shows that the metering conveyor 17 comprises a pivotable bottom wall 51 which can be moved between a normal or closed position (shown in FIG. 8) and an open position which is illustrated in FIG. 7. The construction of the metering conveyor 18 is or can be the same as that of the conveyor 17.

The intercepting receptacle 19 is a relatively shallow bowl or dish (see FIGS. 7 and 8) and is movable between a first or intercepting position (shown in FIG. 7) and a second or discharging position which is illustrated in FIG. 8. The details of means for moving the receptacle 19 (which is preferably similar to or identical with the receptacle 21) are shown in FIGS. 7 and 8.

In FIG. 7, the bottom wall 52 of the receptacle 19 is substantially horizontal and the receptacle 19 is closely or immediately adjacent to the metering conveyor 17. The left-hand portion of the receptacle 19, as viewed in FIG. 7 or 8, is pivotable about the axis of a horizontal shaft 53 which is installed in a stationary bearing member 54. The right-hand side wall 56 of the receptacle 19 (as viewed in FIG. 7 or 8) constitutes a closure or gate which is pivotable with respect to the other walls of the receptacle 19 and serves as a means for permitting evacuation of the material which accumulates in the receptacle 19 as a result of transfer from the associated metering conveyor 17. The upper portion of the closure or gate 56 is pivotable about the axis of a pintle 57 which is parallel to and remote from the shaft 53 and is mounted on the major part of the receptacle 19, i.e., on that part which is movable relative to the closure or gate 56 or vice versa. The right-hand portion 58 of the bottom wall 52 extends to the right beyond the lower edge portion of the closure 56 (when the latter assumes the closed position which is shown in FIG. 7) and slopes downwardly so as to serve as a means for guiding the intercepted material during transfer of such material into the bag 3 of the adjacent container 4 on the chain conveyor 1. The closure 56 normally seals a material evacuating opening 55 of the receptacle 19.

The means 59 for moving the receptacle 19 between the positions of FIGS. 7 and 8 comprises a two-armed lever 62 which is fulcrumed in the frame F of the filling apparatus, as at 61, and is biased in a clockwise direction by a helical spring 66 which operates between the left-hand arm of the lever 62 and a stationary post 66A. The free end of the right-hand arm of the lever 62 is articulately connected to an elongated motion transmitting rod 63 whose upper end portion is articulately connected to the bottom wall 52 of the receptacle 19, as at 63A. A roller follower 64 at the free end of the left-hand arm of the lever 62 tracks the peripheral surface of a rotary disc-shaped cam 68 which is driven by a horizontal camshaft 67. The spring 66 insures that the roller follower 64 remains in permanent contact with the peripheral surface of the cam 68.

The structure which is shown in FIGS. 7 and 8 further comprises a mechanism 76 which automatically pivots the closure 56 relative to the major portion of the receptacle 19 while or after the receptacle is pivoted from the position of FIG. 7 to that which is shown in FIG. 8. The mechanism 76 comprises a linkage 69 which includes a short link 71 connected to the pintle 57, a bell crank lever 73 which is pivotable on a horizontal shaft 72 mounted in the bearing member 54, and a link 74 which connects one arm of the lever 73 with the link 71. The pivot pin 75 which connects the one arm of the bell crank lever 73 with the link 74 can be seen in FIG. 8. In normal (intercepting) position of the receptacle 19, the pivot pin 75 is concealed by and registers with the shaft 53, i.e., by the means which defines a pivot axis for the receptacle 19. The means which imparts motion to the linkage 69 and which forms part of the mechanism 76 includes a disc-shaped rotary cam 84 which is mounted on and can be rotated by a camshaft 83, a two-armed lever 78 which is fulcrumed in the frame F, as at 77, a roller follower 81 on the left-hand arm of the lever 78, a helical spring 82 which is attached to the post 66A and biases the roller follower 81 against the peripheral surface of the cam 84, and an elongated motion transmitting rod 79 which is articulately connected with the right-hand arm of the lever 78 as well as with the other arm of the bell crank lever 73 on the bearing member 54.

The apparatus comprises a prime mover PM (shown schematically in FIG. 7) which continuously drives the camshafts 67 and 83. This prime mover can also transmit motion to the conveyor 1 of FIG. 1 and to other movable parts of the filling apparatus.

The operation is as follows:

Empty boxes 2 are fed into successive holders 26 in a predetermined portion of the elongated path which is defined by the chain conveyor 1. Such boxes are open at the top (2U) and at the bottom (2B) and are introduced into consecutive holders 26 in the region of the sprocket wheel 43. The shaft of the sprocket wheel 43 or 44 is driven in stepwise fashion so that the chain conveyor 1 advances in the direction which is indicated by the arrow X. Successive empty boxes 2 advance to the assembling station 6, i.e., into the portion of the path defined by the chain conveyor 1 which is located below the station for the making of successive empty bags 3. Each bag 3 is closed at the lower end 3B and is open at the upper end 3U. Such bags are formed by drawing a sheet 13 of metallic or plastic foil downwardly and over the shaping member 11 and around the mandrel 12. The resulting tube 3A is transported downwardly by the endless belt or band conveyors 7, 8 and plunger 9 so that successive increments of the tube 3A advance beyond the lower end of the mandrel 12. The tube 3A is already closed at the lower end and such lower end is inserted into the box 2 therebelow in such a way that it is located at a predetermined level above the open lower end 2B of the respective box 2. This is due to the presence of a platform 34 in the interior of the box 2 at the assembling station 6.

The plunger 9 is thereupon retracted to its upper end position, and a severing device 50 (indicated by a broken line) severs the tube 3A at a level above the open upper end 2U of the box 2 at the station 6 so as to form a bag 3. At the same time, the lower end of the remainder of the tube 3A is sealed so as to form the closed lower end of the next bag which is to be introduced into the next-following empty box 2 upon arrival of such box at the station 6.

Platforms 34 are introduced into successive boxes 2 arriving at the assembling station 6 prior to introduction of bags 3 into such boxes. The insertion of platforms 34 is possible because the lower ends 2B of the boxes 2 arriving at the station 6 are partially open due to the fact that only the two shorter bottom flaps **2*f* of each box 2 are folded to horizontal or closed positions at the time the respective boxes move into positions of register with the plunger 9. This is shown in FIGS. 4 and 6 which further show that the longer bottom flaps 2*l* of such boxes are located in two parallel vertical planes and are outwardly adjacent to the upstanding legs of the respective guide rails 28 and 29. Thus, the platforms 34 can readily enter the boxes 2 from below, and their length (as considered at right angles to the plane of FIG. 5) is sufficient to provide an adequate support for the closed lower ends 3B of the descending bags 3 (actually for the closed lower end of the tube 3A which is formed by the parts 11 and 12 at the station 6**).

The length of each bag 3 preferably equals or approximates the length of a box 2 (as measured vertically in FIG. 4 or 5). In other words, when a platform 34 enters a box 2 at the station 6, the distance between the open upper end 3U of a freshly inserted bag 3 and the open upper end 2U of the respective box 2 at the station 6 is the same as the distance between the top surface of an inserted platform 34 and the open lower end 2B of the respective box 2.

The chain conveyor 1 thereupon advances the holders 26 by a step whereby a box 2 with a freshly inserted bag 3 therein reaches the filling station 14. The chain conveyors 32 and 33 are driven in synchronism with the chain conveyor 1 so that, once inserted from below, a platform 34 remains in the interior of the corresponding box 2 and prevents any or any appreciable downward movement of the respective bag 3, i.e., the open upper end 3U of such bag is accessible at a level above the open upper end 2U of the corresponding box 2. The suction applying devices 23 and 24 maintain the upper end portions 3U of the bags 3 arriving at the filling station 14 in open position by attracting the respective portions of the open upper end 3U of each bag to thus ensure that the flowable material which is admitted at the station 14 can enter, without obstruction, into the respective bags 3 and to fill the bags to the desired degree.

The devices at the filling station 14 admit metered quantities of material into successive bags 3. One such filling step is shown in FIGS. 7 and 8. The metering conveyor 17 is assumed to be filled with flowable material. The bottom wall 51 of this conveyor is thereupon pivoted from the closed position of FIG. 8 to the open position of FIG. 7 so that a predetermined quantity of flowable material descends into the intercepting receptacle 19 therebelow. This is indicated by the arrow Q which is shown in FIG. 7. The material which is discharged from the conveyor 17 descends onto the bottom wall 52 of the receptacle 19 and the pivotable bottom wall 51 of the conveyor 17 returns to the closed position of FIG. 8 so that the conveyor 17 can accumulate a fresh batch of flowable material.

In the next step, the shaft 67 rotates the cam 68 so as to cause the lever 62 to move the rod 63 downwardly under the action of the spring 66, i.e., the receptacle 19 is pivoted about the axis of the shaft 53 and assumes the inclined position which is shown in FIG. 8. This causes the projection or extension 58 of the bottom wall 52 to enter into the open upper end 3U of the bag 3 below the receptacle 19. During pivoting of the receptacle 19 in a clockwise direction (from the position of FIG. 7 to the position of FIG. 8), the flowable material which has been supplied by the conveyor 17 slides along the bottom wall 52 against the closure 56 which is still maintained in the closed position of FIG. 7 because, at such time, the roller follower 81 of the lever 78 tracks the cylindrical portion 84A of the peripheral surface on the cam 84. The center of curvature of the portion 84A is located on the axis of the shaft 83 so that the angular position of the lever 78 remains unchanged. In other words, pivoting of the receptacle 19 from the position of FIG. 7 to the position of FIG. 8 does not influence the orientation of the closure 56 with respect to the bottom wall 52 because the pivot pin 75 is coaxial with the shaft 53 which is the fulcrum for the receptacle 19.

The closure 56 is pivoted to the open position of FIG. 8 (i.e., into a substantially vertical plane) when the receptacle 19 reaches the inclined position of FIG. 8. Such pivoting is initiated by the roller follower 81 which then tracks a radially inwardly sloping portion 84B of the peripheral surface on the rotating cam 84 whereby the motion transmitting rod 79 moves lengthwise to pivot the lever 73 which pivots the link 71 through the medium of the link 74. The link 71 is affixed to the pintle 57 which is rigidly connected with the closure 56. As the closure 56 moves toward and reaches the open position of FIG. 8, the material descends by gravity from the interior of the receptacle 19, via opening 55 and into the bag 3 therebelow. In the next step, the cam 68 causes the receptacle 19 to reassume the position of FIG. 7 (the cam 68 moves the receptacle 19 via lever 62, motion transmitting rod 63 and articulate connection 63A), before the cam 84 returns the closure 56 to the position of FIG. 7 via lever 78, rod 79, lever 73, links 74, 71 and pintle 57.

The receptacle 21 in the right-hand portion of the filling station 14 of FIG. 1 can admit a second batch of flowable material to fill the bag 3 which has received a first batch from the receptacle 19. The chain 1 thereupon advances the freshly filled bag 3 to the sealing station 22. Alternatively, the receptacle 19 of FIGS. 7 and 8 can accommodate sufficient quantities of flowable material to completely fill a bag 3. In such filling apparatus, the chain conveyor 1 advances by two steps before the devices at the filling station 14 begin to admit material into a pair of neighboring bags 3. Thus, the receptacles 19 and 21 can admit material, at the same time, into two neighboring bags 3 and such bags are thereupon advanced by a step so that the foremost filled bag 3 reaches the sealing station 22. In accordance with a further embodiment of the invention, the apparatus can be operated in such a way that the receptacles 19 and 21 admit metered quantities of flowable material into the bags 3 therebelow at different times. Thus, the receptacle 19 admits material into the bag 3 therebelow after the receptacle 21 has admitted material into the nearest bag 3. The conveyor 1 is then advanced by a step to move the bag 3, which was filled by the receptacle 21, to the sealing station 22 and to move the bag 3, which was filled by the receptacle 19, into register with the receptacle 21. The latter does not deliver any material into the bag 3 therebelow but the receptacle 19 delivers flowable material into an empty bag 3 in a manner as described above in connection with FIGS. 7 and 8. All that counts is to ensure that a filled bag 3 reaches the sealing station 22 in response to each stepwise advance of the chain conveyor 1 in the direction indicated by the arrow X. The manner in which the sealing means 122 (indicated in FIG. 1 by broken lines) at the station 22 seals the open upper ends 3U of successive (filled) bags 3 is known in the art and need not be described in detail. As a rule, such sealing takes place in response to the application of heat and/or pressure. The sealing means 122 may comprise customary grippers which enter the open upper end 3U of the filled bag 3 at the station 22 to spread such open upper end prior to the application of heat and/or pressure. The sealing action is convenient because the upper end 3U of the filled bag 3 extends well above the upper end 2U of the respective box 2. At such time, the receptacle 21 normally delivers a metered quantity of flowable material into the bag 3 which is located in the right-hand half of the filling station 14 (as viewed in FIG. 1).

The platform 34 is withdrawn from the container 4 which advances beyond the sealing station 22 (or during dwell of such container at the station 22 but subsequent to sealing of the upper end 3U of the respective bag 3). The container 4 then reaches the upwardly sloping portions 31 of the guide rails 28, 29 so that the box 2 rises with respect to the filled and sealed bag 3. If desired, the bag 3 can be pushed downwardly or held against movement in the upward direction while the respective box 2 travels along the upwardly sloping portions 31 of the rails 28, 29. The slope of the portions 31 is selected in such a way that the closed bottom 3B of the filled and sealed bag 3 abuts against the closed bottom 2B of the respective box 2 whereby the upper end of the bag is concealed in the interior of the box.

The containers 4 which advance beyond the sealing station 22 are thereupon subjected to additional treatment at one or more further stations which are not specifically shown in the drawing. Such additional or further treatment involves closing the upper ends of the boxes 2. The closing of each box 2 is completed not later than after the respective containers 4 complete their travel around the sprocket wheel 44 and reach the removing station 46. Empty holders 26 advance along the upper reach of the chain conveyor 1, as viewed in FIG. 1, and back to the station (adjacent to the sprocket wheel 43) where they receive empty boxes 2 for transport to the assembling station 6.

Figure 9:
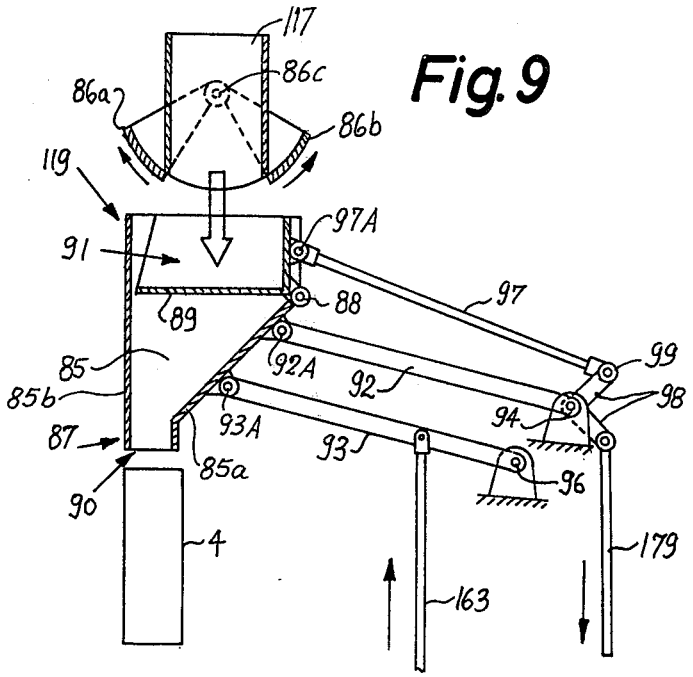
FIG. 9 is a fragmentary partly elevational and partly vertical sectional view of a second filling apparatus with a two-part receptacle and with the bottom wall of the receptacle shown in a position of readiness to receive a batch of flowable material from the metering device.
Figure 10:
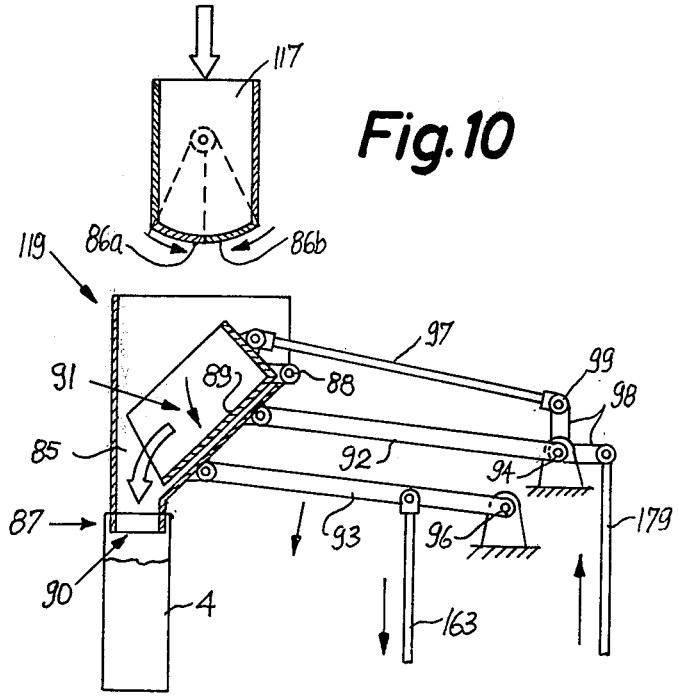
FIG. 10 illustrates the structure of FIG. 9, with the receptacle in a position it assumes during transfer of a batch of flowable material into the bag of a container at the filling station.

FIGS. 9 and 10 illustrate a portion of a modified filling station wherein the metering conveyor 117 includes a composite (two-piece) bottom wall whose sections **86*a*, 86*b* are pivotable about a common axis (pivot member 86*c*) to discharge a flowable material into a modified receptacle 119. When the composite bottom wall of the conveyor 117 opens, its sections 86*a*, 86*b*** are caused to pivot in opposite directions.

The receptacle 119 is a two-piece body having a funnel 85 the lower end portion of which constitutes a nipple 87 which can be inserted into the open upper end 3U of a bag 3 and has a material evacuating opening 90. The upper portion of the funnel 85 contains a vessel 91 which resembles a bowl and has a normally horizontal bottom wall 89. The vessel 91 is pivotable about the axis of a horizontal shaft 88 which is journalled in the funnel 85. The vessel 91 is used for the sake of stability; the apparatus of FIGS. 9 and 10 would operate properly with a receptacle 119 whose inner part consists solely of a bottom wall 89. The side of the vessel 91 which is remote from the shaft 88 is open. The bottom wall 89 constitutes a mobile closure for the opening 90.

The means for moving the funnel 85 between the positions of FIGS. 9 and 10 comprises two links 92, 93 which are articulately connected to an inclined wall **85*a* of the funnel, as at 92A and 93A, and which are respectively pivotable about stationary pivot members 94, 96. An intermediate portion of the link 93 is articulately connected with a motion transmitting rod 163 which is movable up and down by a suitable drive, e.g., a cam and follower unit of the type shown in FIG. 7 for reciprocating of the rod 63 or 79**.

The vessel 91 is articulately connected with a further link 97, as at 97A. The right-hand end portion of the link 97 is articulately connected with one arm of a two-armed lever 98 which is a bell crank and is fulcrumed at 94, i.e., it can turn about the pivot member for the link 92. The other arm of the lever 98 is articulately connected with a motion transmitting rod 179 which is reciprocable by a cam and follower unit not shown in FIGS. 9 and 10.

The operation of the apparatus which includes the structure of FIGS. 9 and 10 is as follows:

When the vessel 91 is held in the position of FIG. 9 (so that the bottom wall 89 is horizontal or nearely horizontal) and the funnel 85 is also held in the position of FIG. 9, the sections 86*a*, 86*b* of the bottom wall of the metering conveyor 117 are caused to open and to discharge a metered quantity of flowable material onto the bottom wall 89. The rod 163 is thereupon caused to move downwardly so that the nipple 87 enters the upper end of the bag forming part of the container 4 at the filling station. The bottom wall 89 of the vessel 91 remains in the substantially horizontal position of FIG. 9 while the nipple 87 enters the bag 3 therebelow. This is due to the fact that the axes of the pivot members 94, 96 and the axis of the pin 99 which connects the link 97 with the lever 98 are located in a common plane. Once the nipple 87 has entered the bag 3, the rod 179 is moved upwardly to pivot the vessel 91 about the axis of the shaft 88 in a counterclockwise direction, as viewed in FIG. 9, to the position which is illustrated in FIG. 10. The rod 179 transmits motion via lever 98 and link 97. The bottom wall 89 of the vessel 91 is moved close to the inclined wall 85*a* of the funnel 85 and the left-hand edge face of the bottom wall 89 is moved away from the wall 85*b* of the funnel 85. This enables the metered quantity of flowable material to leave the vessel 91 by sliding along the downwardly inclined bottom wall 89 and to enter the bag 3 via opening 90 in the nipple 87. In the next step, the rod 163 is moved upwardly and the rod 179 is moved downwardly in order to return the parts 75 and 91 of the receptacle 119 to the positions which are shown in FIG. 9. In the meantime, the conveyor 117 has accumulated a fresh batch of flowable material which is caused to descend onto the bottom wall 89 as soon as the composite bottom wall 86*a*, 86*b* of the conveyor 117 opens.

Figure 11:
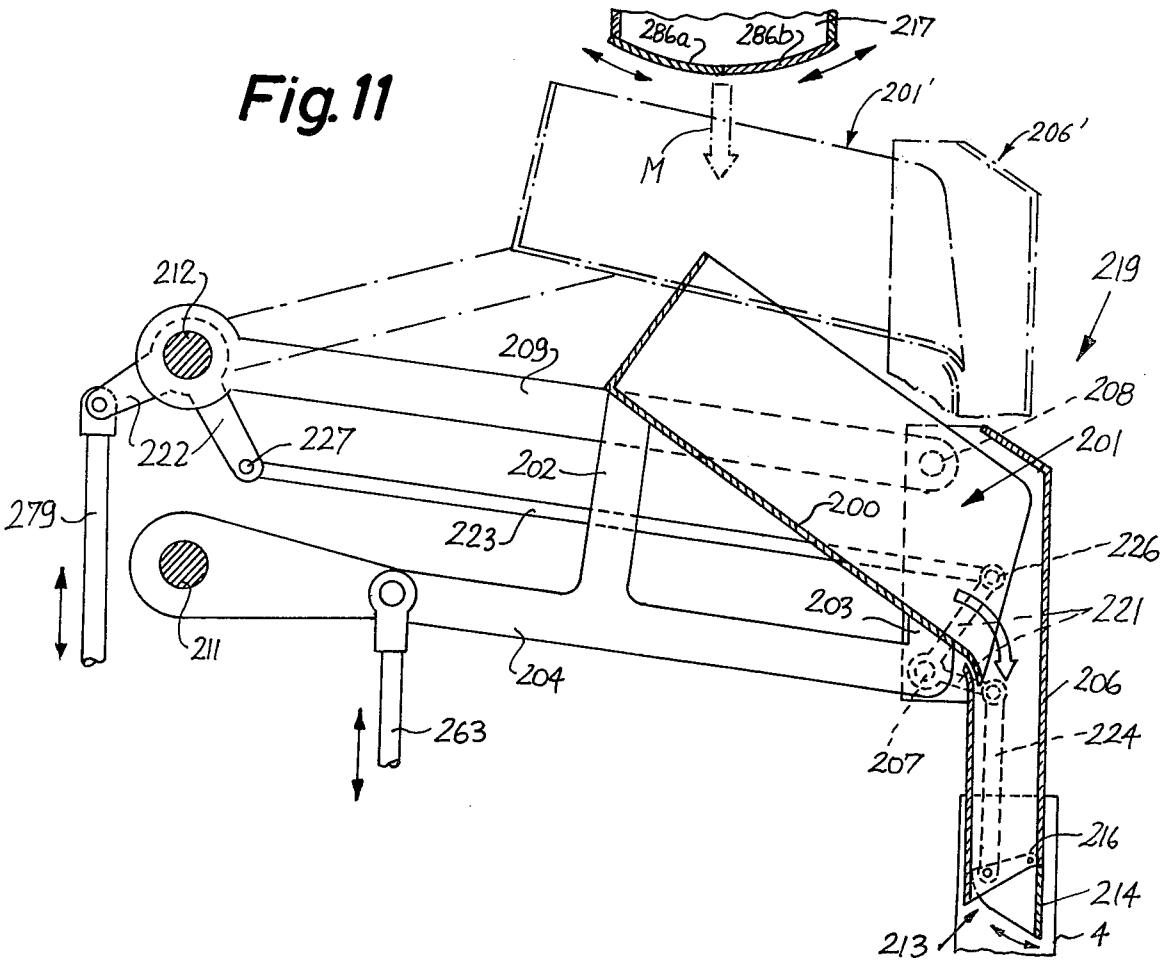
FIG. 11 is a partly elevational and partly vertical sectional view of a third filling apparatus wherein the position of the receptacle during delivery of a batch of flowable material onto its bottom wall is indicated by phantom lines.

FIG. 11 illustrates a portion of a third filling apparatus which is installed at the filling station to admit metered quantities of flowable material into successive or selected containers 4. The metering conveyor 217 is similar to the conveyor 117, i.e., its bottom wall also consists of two sections 286*a*, 286*b* which are pivotable in opposite directions to prevent or permit the descent of flowable material in the direction of the arrow M. The receptacle 219 of FIG. 11 comprises a pivotable vessel 201 which is mounted on a link 204 by way of supporting elements 202, 203. The receptacle 219 further comprises a funnel 206 whose cross-sectional outline is selected in such a way that its lower portion or nipple can be inserted into the open upper end of a bag 3 at the filling station. The funnel 206 is respectively mounted on the link 204 and a second link 209 by way of pivot members 207 and 208. The link 209 is located at a level above and is parallel with the link 204. The left-hand end portions of the links 204, 209 are respectively mounted on stationary horizontal shafts 211 and 212. The means for pivoting the lower link 204 comprises a reciprocable motion transmitting rod 263 which can be moved up and down by a suitable cam and follower unit of the type shown in FIGS. 7 and 8.

The lower end portion or nipple of the funnel 206 carries a gate or closure 214 which can seal the material evacuating opening 213 of the funnel and is pivotable about the axis of a horizontal shaft 216. The pivot member 207 of the link 204 carries a two-armed lever 221, and the shaft 212 for the link 209 supports a second two-armed lever 222. The levers 221 and 222 are coupled to each other by a link 223. The link 223 is connected to one arm of the lever 221 and the other arm of this lever carries a link 224 which is articulately connected with the closure 214. That arm of the lever 222 which is not coupled to the link 223 is articulately connected with a vertically reciprocable motion transmitting rod 279 which receives motion from a cam and follower unit (not shown in FIG. 11). The reference characters 226 and 227 denote pivot pins which respectively connect the ends of the link 223 with the corresponding arms of the levers 221 and 222. When the parts 201 and 206 of the receptacle 219 are held in the raised positions 201' and 206' (indicated by phanton lines), the axis of the pivot member 227 is coplanar with the axes of the shafts 211, 212 and the axis of the pivot member 226 is coplanar with the axes of the pivot members 207, 208.

The operation of the filling apparatus including the structure of FIG. 11 is as follows:

When the vessel 201 is held in the phantom-line (starting) position 201', the sections 286*a*, 286*b* of the bottom wall of the conveyor 217 are moved apart so as to discharge a metered quantity of flowable material onto the bottom wall 200 of the vessel 201. As shown in FIG. 11, the bottom wall 200 of the vessel 201 (in the position 201') is slightly inclined in a direction downwardly and toward the nipple of the funnel 206 (which is held in the phantom-line position 206'). This enables the admitted flowable material to advance, gradually, toward and into the nipple of the funnel 206 even before the parts 201 and 206 move to the solid-line positions of FIG. 11. At such time (i.e., when the funnel 206 is held in the starting position 206'), the closure 214 seals the opening 213 at the lower end of the nipple which forms part of the funnel 206.

The motion transmitting rod 263 is thereupon caused to move downwardly and to pivot the link 204 in a clockwise direction, as viewed in FIG. 11. The link 204 pivots the link 209 because these links are connected to each other by the funnel 206 which moves the lower end of its nipple into the bag 3 of the container 4 at the filling station. While the funnel 206 pivots toward the solid-line position of FIG. 11, the vessel 201 is tilted by the link 204 which is connected to the vessel so that the entire contents of the vessel 201 are introduced into the nipple of the funnel 206. The closure 216 remains in the sealing position during pivotal movement of the funnel 206 to the solid-line position of FIG. 11 because of the aforediscussed positioning of the axes of pivot members 226 and 227, i.e., the axis of the pivot member 227 is coplanar with the axes of the shafts 211, 212 and the axis of the pivot member 226 is coplanar with the axes of the pivot members 207, 208. Once the lower end portion of the nipple of the funnel 206 has entered the bag 3 therebelow, the rod 279 is moved downwardly to move the closure 214 to the open position via lever 222, link 223, lever 221 and link 224, i.e., the metered quantity of flowable material enters the bag 3 of the container 4 shown in the lower right-hand portion of FIG. 11. The parts 201 and 206 of the receptacle 219 are thereupon returned to the phantom-line positions 201' and 206', and the rod 279 is caused to return the closure 214 to the sealing position so that the apparatus is ready for the filling of the next bag 3.

An important advantage of the improved filling apparatus is that the bottom wall 52, 89 or 200 can be moved into close or immediate proximity of the metering device 17, 117 or 217 during transfer of a metered quantity of flowable material into the receptacle 19, 119 or 219, and that the flowable material need not cover a great distance during transfer from the bottom wall into the bag 3 of a container 4 at the filling station. This is due to the fact that the metered quantities of flowable material slide off the bottom wall 52, 89 or 200 toward and into the material evacuating opening 55, 90 or 213 while the opening is located in close proximity of or in the open upper end of the bag 3 at the filling station.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

I claim:

1. Apparatus for transferring a flowable material into successive containers having open ends, comprising means for transporting containers along a predetermined path; a metering device located above a portion of said path and arranged to accumulate and discharge metered quantities of flowable material; a receptacle disposed intermediate said metering device and a container in said portion of said path and having a bottom wall and a material evacuating opening, said receptacle being movable between a first position in which said wall is closely adjacent to said metering device to receive a metered quantity of material and a second position in which said opening is at least closely adjacent to the open end of a container in said portion of said path at a level below said wall and said wall slopes downwardly so that the metered quantity of material enters the container in said portion of said path by sliding off said wall and by passing through said opening; means for moving said receptacle between said positions; a mobile closure for the opening of said receptacle; and means for moving said closure with reference to said bottom wall to a closed position not later than when said receptacle assumes said first position so that the opening is closed during admission of a metered quantity of material and to an open position not later than when said receptacle assumes said second position so that the material which slides off said bottom wall can pass through said opening.

2. The apparatus of claim 1, wherein said opening extends into the container in said portion of said path in response to movement of said receptacle to said second position and said wall is immediately adjacent to said metering device in said first position of said receptacle.

3. The apparatus of claim 1, wherein said receptacle includes a first part which comprises a funnel and is provided with said opening and a second part which includes said bottom wall.

4. The apparatus of claim 3, wherein said moving means includes means for pivoting said bottom wall between a substantially horizontal position in which said bottom wall is ready to receive a metered quantity of material from said metering device and a further position in which said bottom wall slopes downwardly into said funnel and is sufficiently inclined to discharge the metered quantity of flowable material by gravity flow whereby the flowable material leaves the funnel by way of said opening.

5. The apparatus of claim 4, wherein said funnel tapers downwardly at a level below said bottom wall and said opening is disposed at the lower end of said funnel.

6. The apparatus of claim 1, wherein said receptacle includes a bowl having a side wall which constitutes said mobile closure and is movable between closed and open positions to respectively expose and seal said opening.

7. The apparatus of claim 6, wherein said receptacle is pivotable about an axis which is remote from said side wall.

8. The apparatus of claim 6, wherein said side wall is pivotable about a first substantially horizontal axis and said receptacle is pivotable between said positions about a second pivot axis which is remote from and substantially parallel to said first axis.

9. The apparatus of claim 1, wherein said receptacle comprises a funnel having a lower end provided with said opening and a vessel installed in said funnel and including said bottom wall, said moving means including means for moving said vessel simultaneously with said funnel.

10. The apparatus of claim 9, wherein said vessel is a bowl which has an open side at a level above said bottom wall in said first position of said receptacle.

11. The apparatus of claim 9, wherein said means for moving said receptacle comprises two substantially parallel links for said funnel, and means for pivoting said links to thereby move said funnel between said first and second positions, said vessel being secured to one of said links.

12. The apparatus of claim 1, wherein said metering device comprises a conveyor having a bottom wall movable to and from an open position in which said conveyor discharges a metered quantity of flowable material onto the bottom wall of said receptacle.

13. The apparatus of claim 12, wherein the bottom wall of said conveyor includes a plurality of sections which are movable relative to each other.

* * * * *